United States Patent [19]

Lovaas et al.

[11] 4,053,139

[45] Oct. 11, 1977

[54] BOOM POINT SHEAVE ASSEMBLY

[75] Inventors: M. J. Lovaas, Crystal Lake, Ill.; Roger J. Voecks, South Milwaukee, Wis.

[73] Assignee: Bucyrus-Erie Company, South Milwaukee, Wis.

[21] Appl. No.: 579,649

[22] Filed: May 21, 1975

[51] Int. Cl.[2] ..... B66D 1/36

[52] U.S. Cl. ..... 254/190 R; 212/59 R

[58] Field of Search ..... 254/190 R, 192, 139 R, 254/139.1; 212/39 R, 70, 1, 59 R, 65; 74/230.1; 308/18, 21; 37/116

[56] References Cited

U.S. PATENT DOCUMENTS

| | | | |
|---|---|---|---|
| 2,042,460 | 6/1936 | Fykse | 254/190 R |
| 2,279,887 | 4/1942 | Hathorn | 254/190R |
| 2,321,549 | 6/1943 | Holmes | 212/59 R |
| 2,813,636 | 11/1957 | Preston | 212/59 R |
| 2,846,082 | 8/1959 | Heitz | 212/59 R |
| 3,680,840 | 8/1972 | Pech | 212/39 R |
| 3,684,245 | 8/1972 | Marichev et al. | 254/190 R |
| 3,757,959 | 9/1973 | Thompson et al. | 212/59 R |
| 3,797,672 | 3/1974 | Vermette | 212/59 R |
| 3,829,992 | 8/1974 | Reid et al. | 254/190 R |
| 3,877,581 | 4/1975 | Auxer | 212/65 |
| 3,959,899 | 6/1976 | Rangaswam | 254/190 R |

*Primary Examiner*—Albert J. Makay
*Assistant Examiner*—Kenneth Noland
*Attorney, Agent, or Firm*—Quarles & Brady

[57] ABSTRACT

A boom point sheave assembly has a sheave shaft which extends transversely of the boom point pivotally mounted at its center in the boom point. Each end of the sheave shaft extends beyond a side of the boom point and rotatably mounts a sheave. A torque rod having one end anchored to the boom point and its other end fixed to the sheave shaft exerts a restoring torque on the sheave shaft should the sheave shaft pivot away from its normal horizontal position.

4 Claims, 5 Drawing Figures

Fig. 3
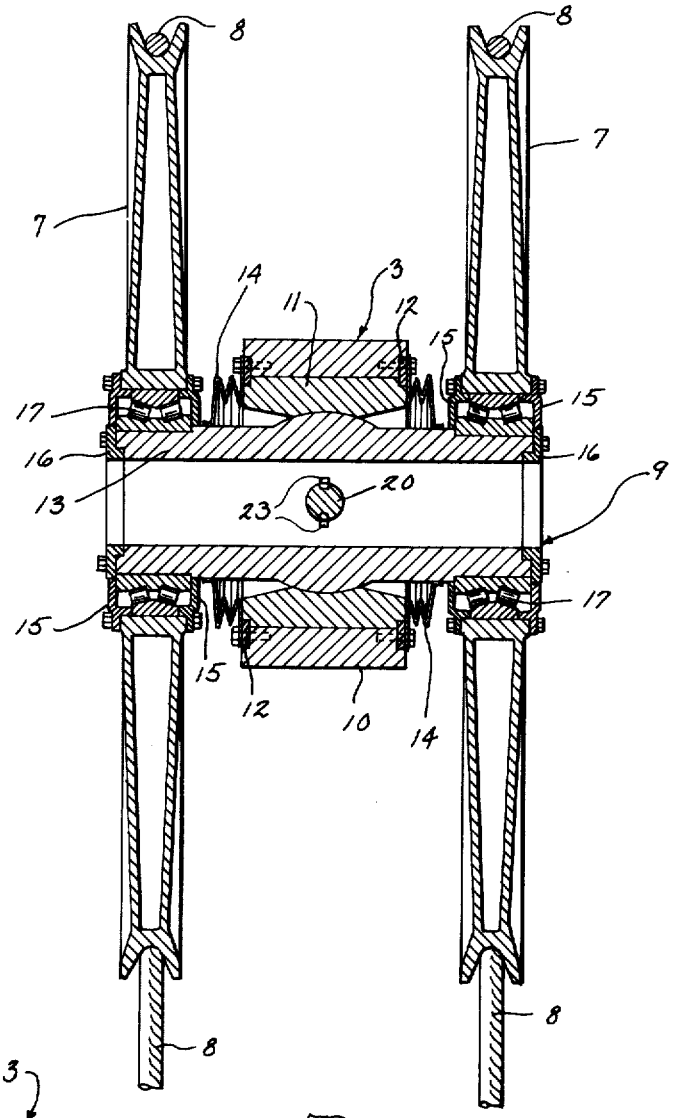
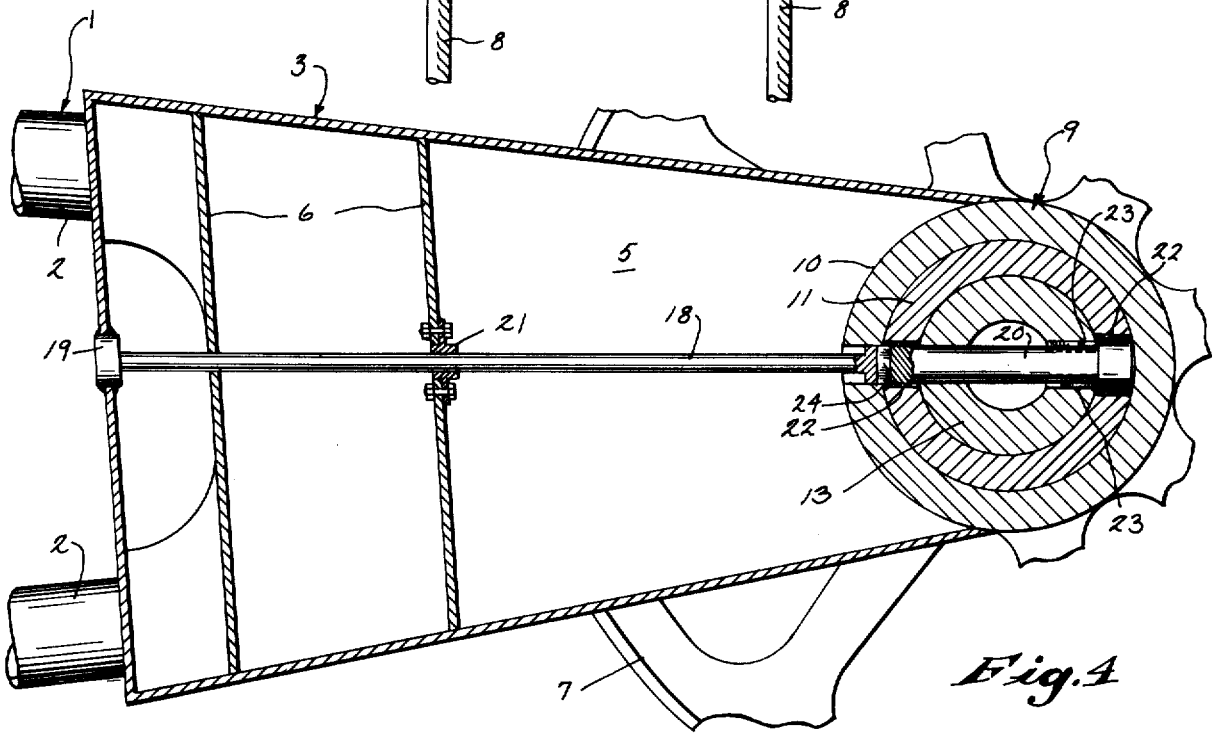
Fig. 4

29
30
28
27
28
29
26
26
26
25

BOOM POINT SHEAVE ASSEMBLY

BACKGROUND OF THE INVENTION

This invention relates to material handling equipment, and, more particularly, to a boom point sheave assembly for the outer end of a material handling boom, such as in a dragline excavator or crane.

Material handling machinery is commonly provided with a boom which is capable of moving in a vertical plane. Vertically oriented sheaves are mounted on the outer end of the boom and each sheave has a hoist rope reeved therearound. Additionally, the boom typically can swing from side to side, and as the boom is swung the rope and its load may lag behind the sheaves and develop a certain amount of "offlead" between the boom point sheaves and the suspended load. Each hoist rope then extends at an angle with respect to the plane of its corresponding sheave. This may result in severe frictional wear on the hoist rope and significantly reduce its useful life. Another consequence is that torsional stresses are imposed on the boom from the "offlead", or lagging of the load.

To reduce the frictional wear on the hoist ropes and torsional stresses incidental to the offlead situation, it is common to provide a boom point sheave assembly which is able to follow the hoist rope misalignment. A typical boom point sheave assembly designed for overcoming these offlead difficulties is disclosed in U.S. Pat. No. 2,042,460 issued to M. J. Fykse on June 2, 1936. In this patent, a sheave is rotatably carried by a sheave pin which is supported at the lower end of a yoke. The yoke is mounted for swinging motion on trunions disposed on a transversely extending pin at a position which is equidistant between the side plates of the boom. This arrangement has been quite satisfactory, but the present invention is intended to improve upon the Fykse construction.

Other boom point sheave assemblies which allow the sheaves to move towards the plane of the hoist ropes during offlead are known to those in the art. For example, in U.S. Pat. No. 3,757,959 granted to Thompson et al. on Sept. 11, 1973, a pair of sheaves are swivelly mounted on a shaft on a ball portion formed at its midpoint while the shaft is fixed at each end to the outer end of the boom. Since the sheaves are mounted on the enlarged ball portion, conventional sheaves cannot be employed in this assembly, and sheaves having large internal diameters and large bearings must be used. In U.S. Pat. No. 3,684,245 issued to Marichev et al. on Aug. 15, 1972, a transversely extending sheave-supporting shaft is connected at each end to the boom. A sheave is mounted between the sides of the outer end of the boom, and on a pin having a longitudinal axis upwardly disposed with respect to the central axis of the boom. The shaft in this patent also is fixed to the outer end of the boom, with the sheave mounted at its center. In both of these prior art arrangements, heavy bending loads can be imposed on the shaft. If the sheave shafts are increased dimensionally to accommodate heavy bending loads, structural weight is added to the boom point.

SUMMARY OF THE INVENTION

The present invention contemplates an improved boom point sheave assembly having a sheave shaft pivotally mounted between its ends in a boom point, in a position extending transversely of the boom point with its ends extending sidewardly of the boom point, and a pair of sheaves each rotatably mounted upon an end of the sheave shaft.

It is a general object of the invention to provide a boom point sheave assembly which diminishes the adverse consequences commonly associated with offlead circumstances. This is accomplished by employing a construction which features a sheave shaft pivotally mounted at its center in the boom point. The sheave shaft pivots in response to the forces exerted on the sheaves by the hoist ropes during offlead. This pivotal movement causes the sheaves to move into the plane of the hoist ropes. This feature provides for a substantial reduction in the frictional wear of the hoist ropes and the torsional stresses which can be exerted on the boom during offlead conditions.

It is another general object of the invention to provide a boom point sheave assembly which effects a reduction in the structural weight of the outer end of the boom. The ends of the sheave shaft extend sidewardly of the boom point and a sheave is rotatably mounted on each end. This construction permits the boom chords to be brought close together at the outer end of the boom leading to a minimization of structural weight at the boom point. This feature especially provides for a reduction of bending loads on the sheave shaft while maximizing the strength of the outer end of the boom.

It is a further object of the invention to provide a boom point sheave assembly having an effective apparatus for centering the sheave shaft in its normal horizontal plane after displacement by offlead of the load. A torque rod extends longitudinally of the boom point and has one end anchored to the boom point and its opposite end fixed to the sheave shaft. When the sheave shaft pivots away from its normal position, the rod exerts a restoring torque on the shaft urging it back towards its normal position.

And, it is another object of the invention to mount a pair of sheaves on the sheave shaft, yet provide a construction which minimizes the possibility that the hoist ropes reeved around the sheaves will twine. A sheave is mounted on each end of the sheave shaft, and, consequently, the sheaves are spread apart decreasing the likelihood of twining of the two hoist ropes.

Yet another object of the invention is to provide a boom point sheave assembly that is highly effective and durable in overcoming the foregoing problems, but that is also relatively inexpensive and easy to manufacture, assemble, maintain and use.

The foregoing and other objects and advantages of the invention will appear from the following description. In the description, reference is made to the accompanying drawings, which form a part hereof, and in which there is shown by way of illustration and not of limitation two preferred embodiments of the invention. Such embodiments do not represent the full scope of the invention, but rather the invention may be employed in many different embodiments, and reference is made to the claims herein for interpreting the breadth of the invention.

BRIEF DESCRIPTION OF THE DRAWINGS

FIG. 3 is a view in cross section taken along the plane of the line 3—3 shown in FIG. 1;

FIG. 4 is a view in cross section taken along the plane of the line 4—4 shown in FIG. 2.

DESCRIPTION OF THE PREFERRED EMBODIMENT

Figure 1:
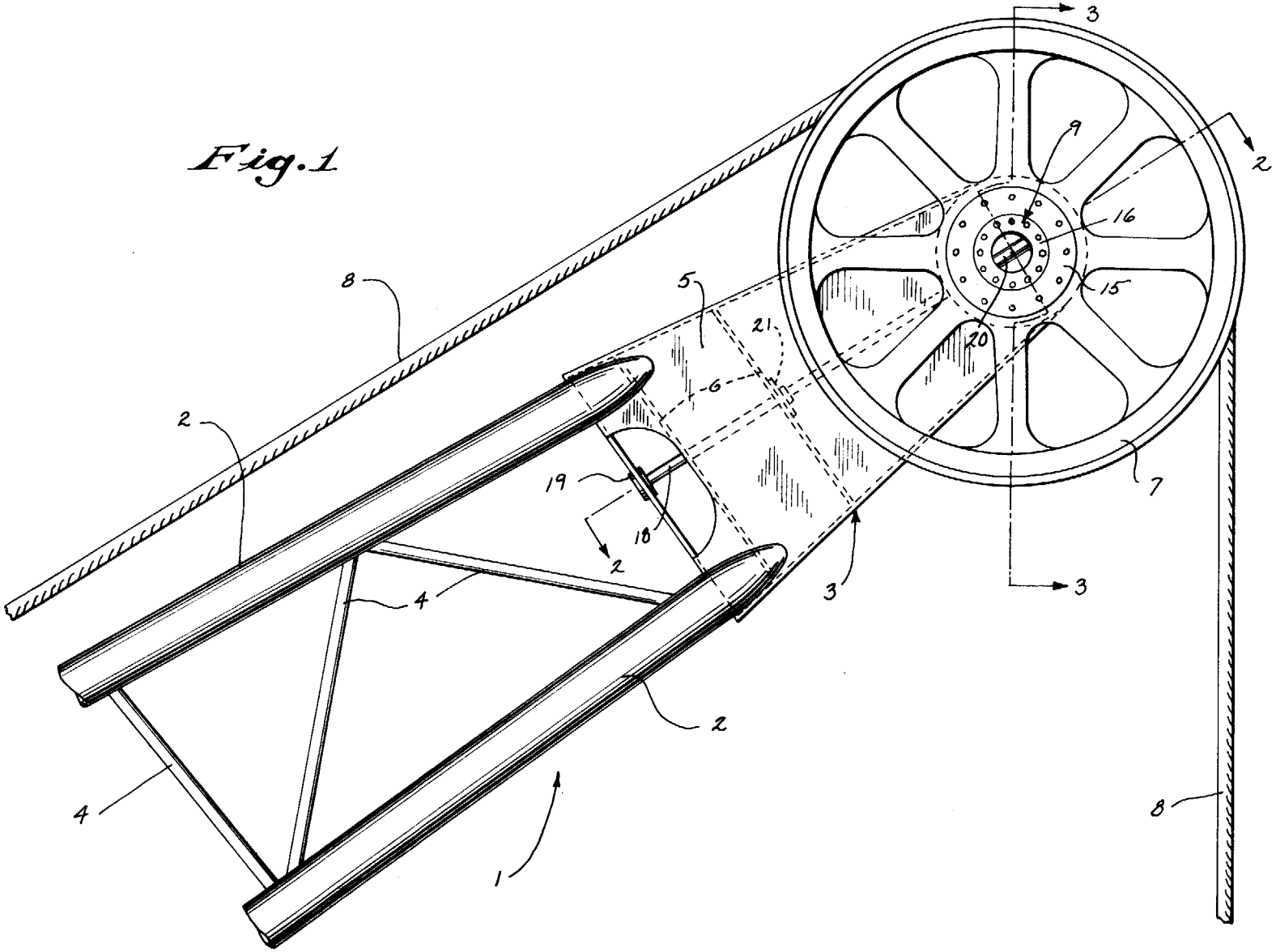
FIG. 1 is a side view of the outer end of a boom incorporating the boom point sheave assembly of the present invention.

Referring to FIG. 1, the outer end of a boom, generally designated by the reference numeral 1, is suitable for use on a dragline. The boom 1 includes upper and lower chords 2 which are connected to and terminate at a boom point 3. Vertically and diagonally extending lacings 4 are spaced between the chords 2, and therewith provide a truss construction for the boom 1. The boom point 3 includes two vertical, parallel side frames 5 having vertical stiffening webs 6 extending therebetween in parallel spaced relationship to provide additional structural strength for the boom point 3. A sheave 7 is rotatably mounted on each side of the boom point 3 and a hoist rope 8 is reeved around each sheave 7 and extends downwardly toward a suspended load.

Figure 2:
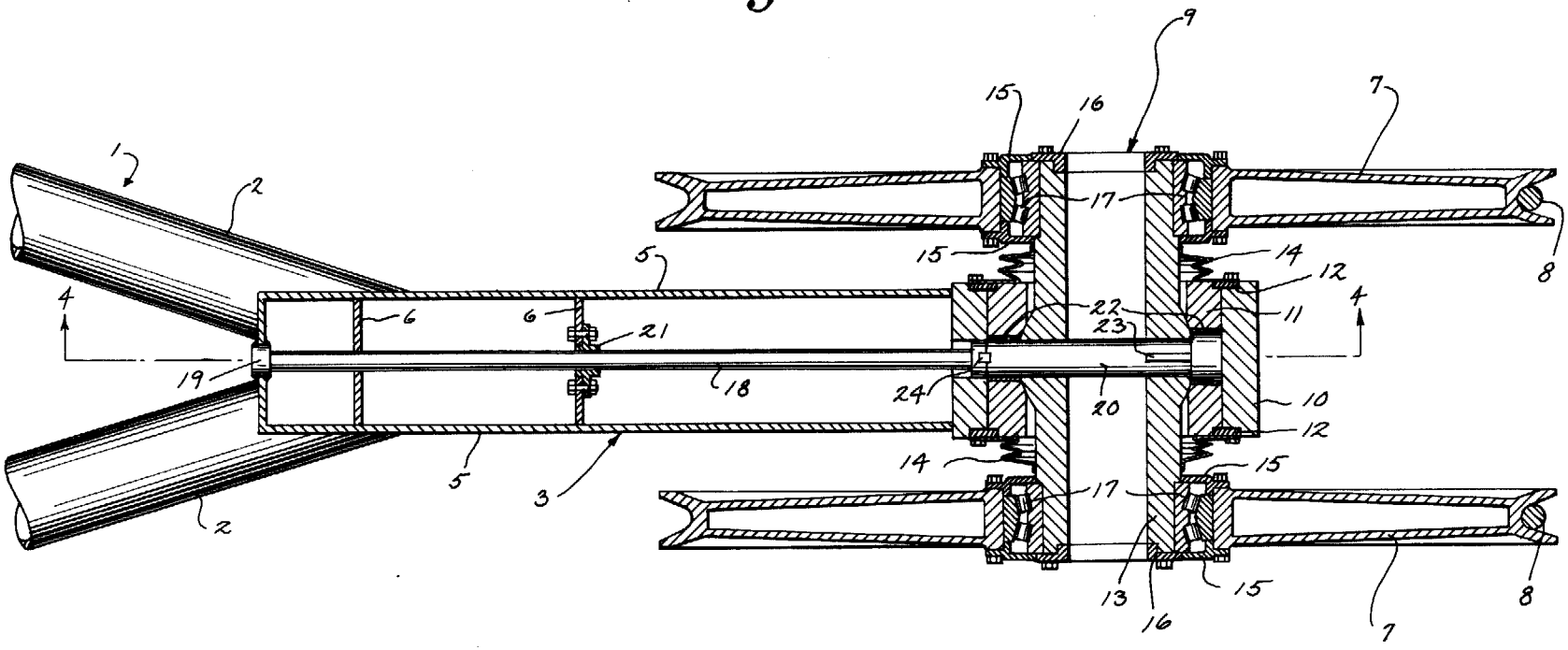
FIG. 2 is a view in cross section taken along the plane of the line 2—2 shown in FIG. 1.

Referring now to FIGS. 2–4, the improved boom point sheave assembly, generally designated by the reference numeral 9, is mounted on the front end of the boom point 3. The boom point sheave assembly 9 has a socket 10 which forms a housing for a bearing seat 11 that is mounted to the socket 10 by a pair of clamp rings 12. The bearing seat 11 has a transverse opening which runs crosswise of the boom point 3, and a normally horizontally disposed sheave shaft 13 passes through the opening and extends sidewardly on each end beyond the boom point 3. The sheave shaft 13 has a curved bearing surface at its center which engages the bearing seat 11. A protective cover 14 is mounted to the sheave shaft 13 and the bearing seat 11 on each outer side of the bearing seat 11.

As previously indicated, each end of the sheave shaft 13 extends beyond one side of the boom point 3, and a sheave 7 is rotatably mounted on each end of the sheave shaft 13 with a hoist rope 8 reeved therearound. The sheave mounting construction includes a generally conventional bearing arrangement. Each sheave 7 has a hub concentric therewith which is composed of a pair of annular retaining elements 15 and 16. A set of bearing members 17 are enclosed within the interior of each hub and allow the sheaves 7 limited movement with respect to the sheave shaft 13.

Each hoist rope 8 extends downwardly from one of the sheaves 7, and lies within the same vertical plane as its corresponding sheave when the boom 1 is in its rest position. However, when the hoist ropes 8 are attached to a heavy load and lateral movement of the boom 1 is commenced, there usually is a certain amount of time lag before sideward movement of the load is initiated. Thus, during the lateral displacement of the boom 1, the load is not oriented within the same vertical plane as the sheaves 7. Consequently, the hoist ropes 8 become disposed in a plane which forms an angle with respect to the vertical. This is the commonly encountered "offlead" situation to which earlier reference was made. During the movement of the boom 1, the boom point sheave assembly 9 permits the sheaves 7 to tilt sidewise into the same plane as the hoist ropes 8. The angular pulling force exerted on the assembly 9 by the ropes 8 causes the sheave shaft 13 to pivot within the bearing seat 11. As a result, the sheaves 7 tilt simultaneously into alignment with the hoist ropes 8 diminishing wear of the ropes 8 and torsional stress on the boom.

The transverse opening in the bearing seat 11 defines a central axis passing through the centerline thereof which perpendicularly bisects the central boom point axis. The central axis of the sheave shaft 13 is coincident with the central axis of the transverse opening. As the sheave shaft 13 pivots from its normal position, its central axis forms an acute angle with the central axis of the transverse opening.

As seen in FIG. 3, the inner circumferential surface of the bearing seat 11 which engages the curved bearing surface of the sheave shaft 13 is beveled away from the sheave shaft 13 towards its outer periphery on each side. The beveled surfaces of the bearing seat 11 serve to limit the degree to which the sheave shaft 13 may tilt from its normal horizontal position during an offlead situation.

With particular reference to FIGS. 2 and 4, a torque rod 18 extends longitudinally of the boom point 3. The rear end of the torque rod 18 is mounted on the boom point 3 within anchor bracket 19 which is connected to the side frames 5. The torque rod 18 extends forwardly along the central axis of the boom point 3 and has a headed end extending into a longitudinal bore formed in the rearmost portion of the socket 10. The headed end abuts the after end of a cross shaft 20, and as seen in FIGS. 2 and 4 a key 24 connects the torque rod 18 and cross shaft 20 so that they will twist or turn together. Except for twisting, the torque rod 18 remains stationary at all times with respect to the boom point 3 and its rear end is held fixed from rotation by the anchor bracket 19. The cross shaft 20 and a guide 21 which is fastened to the forward stiffening web 6 support the rod 18 in its alignment with the cross shaft 20.

The cross shaft 20 perpendicularly bisects the bearing seat 11 and the sheave shaft 13. The ends of the cross shaft 20 extend through longitudinal bores in the bearing seat 11 that are of slightly larger diameter to accommodate a set of bushings 22 that are interposed between the cross shaft 20 and the bearing seat 11 in positions fore and aft of the curved bearing surface of the sheave shaft 13. The cross shaft 20 is also snugly borne by the sheave shaft 13 and is fixed thereto by a pair of keys 23 to insure a locking union between the cross shaft 20 and the sheave shaft 13. Thus, when the sheave shaft 13 pivots in the bearing seat 11, the cross shaft 20 rotates within the bushings 22 about its central longitudinal axis, which is coincident with the central boom point axis, and applies torque to the rod 18.

Although the torque rod 18 remains stationary with respect to the boom point 3, it may exercise limited twisting rotational movement about the central axis of the boom point 3. Hence, upon rotation of the cross shaft 20, the torque rod 18 becomes twisted about the central boom point axis. The twisted rod 18 exerts a restoring torque on the sheave shaft 13, tending to return it to its normal horizontal rest position.

The invention provides a boom point sheave assembly 9 that utilizes a single mounting of the sheave shaft 13 by the boom point 3. This is accomplished by forming a curved bearing surface at the center of the sheave shaft 13, which engages a bearing seat 11 on the forward end of the boom point 3. The sheave shaft 13 can rock within the bearing seat 11 about the central boom point axis in a bogie-type fashion. By allowing pivotal movement of the sheave shaft, the sheaves 7 can tilt in the plane of the hoist ropes 8 during offlead conditions, thus reducing a significant amount of rope wear and torsional stress on the boom. The pivotal movement of the sheave shaft 13 is controlled by a torque rod 18 extending longitudinally of the boom point 3. When the sheave shaft 13 pivots away from its normal horizontal alignment, the rod 18 becomes twisted and exerts a restoring torque on the sheave shaft 13, urging it back to normal rest position. The extent of sheave shaft pivotal movement is limited by the construction of the bearing seat 11. The sheave shaft 13 may pivot from the horizontal until its upper surface contacts one of the beveled inner circumferential surfaces of the bearing seat 11.

The boom point sheave assembly accomplishes the objectives typically sought in a movable arrangement of this type—reduction of hoist-rope wear and torsional stress on the boom during offlead—yet, it also reduces weight at the outer end of the boom, while utilizing structural materials of conventional size.

Figure 5:
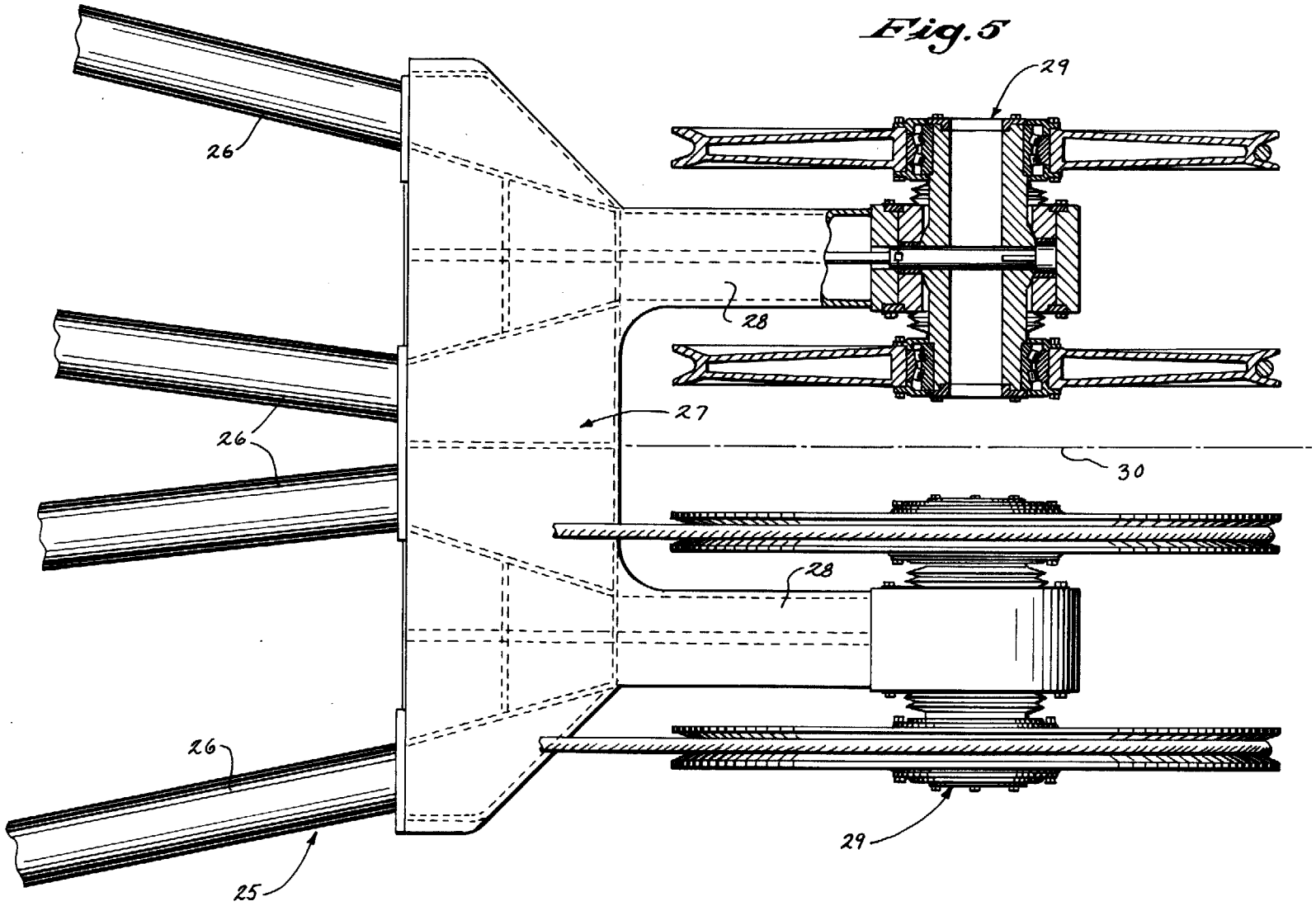
FIG. 5 is a view in cross section, similar to FIG. 2, showing a second embodiment having a pair of boom point sheave assemblies on the outer end of a boom.

It should be apparent to those skilled in the art that numerous variations can be made in the above described arrangement without departing from the spirit of the invention. For example, with reference to the second embodiment of FIG. 5, the outer end of a boom, generally designated by the numeral 25, is shown. The boom 25 includes chords 26 which are connected at their forward ends to a mounting structure 27. The mounting structure 27 spans the entire boom width and includes a pair of boom points 28, each of which mounts a boom point sheave assembly 29 identical to the one described heretofore. It should be noted that the mounting arrangement is symmetrical about an axis 30 passing through the centerline of the boom 25. During offlead, this arrangement reduces hoist-rope wear and torsional stress on the boom 25, similarly as in the first embodiment.

While the term "boom point" has been used herein in reference to a boom outer end of box like construction, it is not intended that there be any limiting sense in the use of this term. A boom point may consist of any convenient outer end construction suitable for mounting the bearing that supports the pivoted sheave shaft.

We claim:

1. In a boom point sheave assembly for the outer end of a material handling boom, the combination comprising:

a bearing seat mounted directly to the end of the boom and having an opening running crosswise to the boom length in a generally horizontal direction;

a sheave shaft extending through said opening with a central curved bearing surface rockably received within said bearing seat, and having opposite ends extending sideward from the central bearing surface to overhang from the sides of the boom; and a pair of hoist sheaves each rotatably mounted directly on an end of said sheave shaft and disposed on said sheave shaft outboard of the boom, said sheaves tilting sidewise in unison with a rocking motion of said shaft to reduce torsional stress on the boom during hoist rope offlead.

2. The boom point sheave assembly as recited in claim 1, having means for limiting the extent of sheave shaft pivot.

3. In a boom point sheave assembly, the combination comprising:

a boom outer end;

a housing mounted directly on said boom outer end and having a transverse opening, which defines a housing axis perpendicular to the direction of the boom length;

a sheave shaft mounted within said housing having ends that extend sidewardly from and overhang said housing and said boom outer end, said sheave shaft pivoting at its center within said housing so that upon pivoting its central axis forms an acute angle with the housing axis;

a hoist sheave mounted on each end of said sheave shaft and disposed directly on said sheave shaft outboard of said boom outer end; and a cross shaft longitudinal of said boom that passes through said sheave shaft in a position concentric with sheave shaft pivot and that extends into said housing, thereby limiting the direction of pivot of said sheave shaft.

4. A boom point sheave arrangement, comprising:

a boom outer end; and first and second boom points mounted by said boom outer end;

said first boom point being mounted to one side of the centerline of the boom and having:

a first sheave shaft pivotally mounted within a first bearing seat fixedly connected to said first boom point, said first sheave shaft extending transversely of said first boom point with the ends thereof extending on each side of said first boom point; and a pair of hoist sheaves each rotatably mounted directly upon respective ends of said first sheave shaft and disposed on said first sheave shaft outwardly of said first boom point;

said second boom point being mounted to the other side of the centerline of the boom and having:

a second sheave shaft pivotally mounted within a second bearing seat fixedly connected to said second boom point, said second sheave shaft extending transversely of said second boom point with the ends thereof extending on each side of said second boom point; and a pair of hoist sheaves each rotatably mounted directly upon respective ends of said second sheave shaft and disposed on said second sheave shaft outwardly of said second boom point;

said first and second boom points being symmetrically disposed with respect to the centerline of the boom.

* * * * *